United States Patent [19]

Shinoda

[11] Patent Number: 4,657,477

[45] Date of Patent: Apr. 14, 1987

[54] PORTABLE ENGINE-BLOWER SUPPORTING DEVICE

[76] Inventor: Gen Shinoda, No. 7, Inaoka 7-chome, Chiba-shi, Chiba-ken, Japan

[21] Appl. No.: 784,700

[22] Filed: Oct. 4, 1985

[30] Foreign Application Priority Data

Oct. 15, 1984 [JP] Japan ..... 59-154294[U]

[51] Int. Cl.[4] ..... F04D 29/40; A47L 5/24

[52] U.S. Cl. ..... 415/126; 415/219 C; 417/234; 15/410; 16/112; 403/98; 239/375

[58] Field of Search ..... 415/126, 127, 121 R, 415/219 C; 417/234; 15/405, 410; 16/110 R, 112, 114 R, 124; 403/61, 84, 98; 239/375; 74/543, 504

[56] References Cited

U.S. PATENT DOCUMENTS

| | | | |
|---|---|---|---|
| 579,277 | 3/1897 | Lord et al. | 74/543 X |
| 2,416,621 | 2/1947 | Gretschel | 16/114 R X |
| 2,540,579 | 2/1951 | Hanner | 16/112 X |
| 2,739,537 | 3/1956 | Sadler | 417/234 X |
| 4,078,866 | 3/1978 | Hawkins | 403/98 X |
| 4,461,055 | 7/1984 | Zerrer et al. | 417/234 X |

FOREIGN PATENT DOCUMENTS

| | | | |
|---|---|---|---|
| 130876 | 3/1929 | Switzerland | 16/114 R |

*Primary Examiner*—Edward K. Look
*Assistant Examiner*—Joseph M. Pitko
*Attorney, Agent, or Firm*—Stevens, Davis, Miller & Mosher

[57] ABSTRACT

A portable engine-blower supporting device in which a handle suspending a fan case provided with an engine is always maintained in a horizontal state through adjusting holes.

1 Claim, 6 Drawing Figures

PORTABLE ENGINE-BLOWER SUPPORTING DEVICE

BACKGROUND OF THE INVENTION

This invention relates to a portable engine-blower supporting device which can always horizontally hold a handle suspending a fan case with an engine encased therein in a comfortable attitude and without giving an operator a useless laborious burden.

PRIOR ART

In a portable engine blower in which a handle is mounted on the upper surface of a fan case encasing an engine therein, the handle has been secured to the fan case. Therefore, when a discharge opening is directed, for example, downwardly, the handle itself had to be gripped so that the discharge opening side was directed downward. This makes it absolutely impossible to hold the handle for a long period of time. Because of this, auxiliary means such as a wedge-shaped support base need be provided. Furthermore, when the direction of the discharge opening is changed, the holding position of the handle has to be changed accordingly. If the aforementioned auxiliary means is used, the laborious burden may be relieved. However, it is extremely cumbersome and absolutely impossible to provide the auxiliary means in a manner that said means may be always fitted to the set position of the discharge opening. For this reason, the set direction of the discharge opening is compelled to be maintained when the holding position of the handle is changed. However, it would unavoidably be impossible to maintain the same set position for a long period of time in consideration of a mental and physical burden of the operator.

SUMMARY OF THE INVENTION

It is an object of the present invention to provide an arrangement wherein the discharge opening side of the fan case is pivotally mounted on one side of a handle whilst the other side of the fan case is mounted on the other side of the handle through adjusting holes, whereby the handle is always maintained in a horizontal state.

It is a further object of the present invention to provide an arrangment wherein the setting position to the handle may be easily adjusted through adjusting holes provided on the fan case side.

The present invention provides a portable engine-blower supporting device in which a lower portion of a handle is connected to through holes and adjusting holes respectively bored in large and small projecting members projected upwardly of a fan case, whereby the fan case may be tilted through the adjusting holes as necessary to always maintain the handle in a horizontal state for handling the blower in a comfortable attitude.

DETAILED DESCRIPTION OF THE INVENTION

Construction

Figure 1:
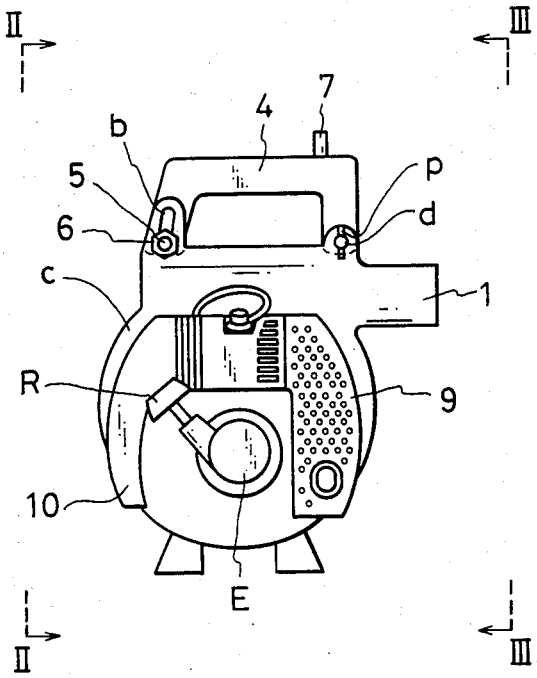
FIG. 1 is a front view when a discharge opening is in a horizontal position.
Figure 2:
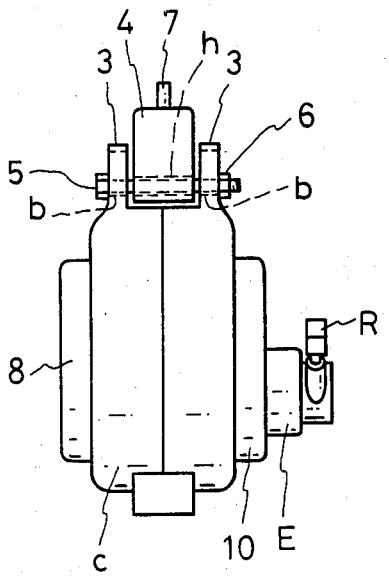
FIG. 2 is a view taken on line II—II of FIG. 1.
Figure 3:
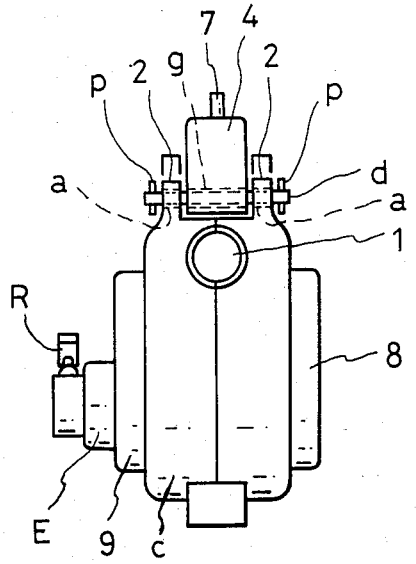
FIG. 3 is a view taken on line III—III of FIG. 1.
Figure 4:
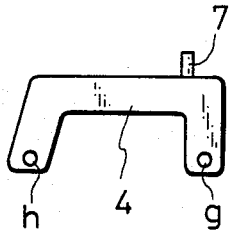
FIG. 4 is a front view of a handle.

A preferred embodiment of the present invention will now be described with reference to FIGS. 1 through 6. A discharge opening 1 is formed on one side (on the right side in FIG. 1) of a two-split type fan case C having an engine E integrally coupled thereto. Through holes a, a are respectively bored in the central portions of a pair of projecting members 2, 2 projected approximately in a semicircular fashion upwardly of the discharge opening 1, and oval adjusting holes b, b are respectively bored in a pair of upright members 3, 3 projected upwardly on the other side (on the left side in FIGS. 1, 5 and 6) of the fan case C. Through holes g, h are respectively bored on both sides of a flat inverted U-shaped handle 4. A support shaft d extends through and is loosely fitted over the through hole g and the projecting members 2, 2. Stop pins p, p as seen in FIG. 3 are inserted into portions near the ends of the support shaft d or a nut is screwed around a screw provided on the end of the support shaft d (though not shown) to prevent the support shaft d from being disengaged from the through holes a, a. The adjusting holes b, b are suitably registered with the through hole h of the handle 4, and a bolt 5 as seen in FIG. 2 is suitably inserted into the registered portion and fastened by a nut. In the figures, reference numeral 7 designates a throttle valve, 8 an intake opening cover, 9 a muffler cover, 10 an air cleaner and R a recoil starter.

Operation

Figure 6:
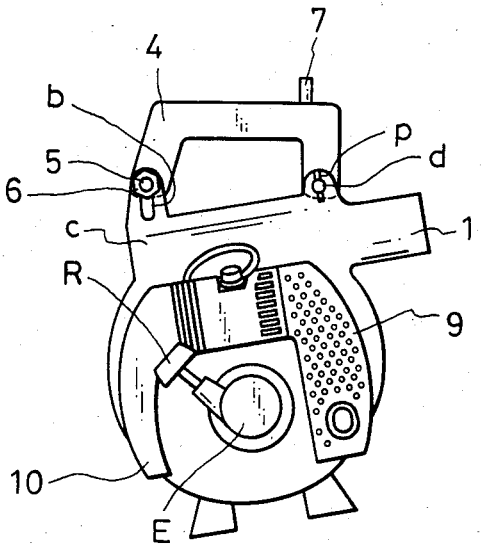
FIG. 6 is a front view when the discharge opening is directed upwardly.
Figure 5:
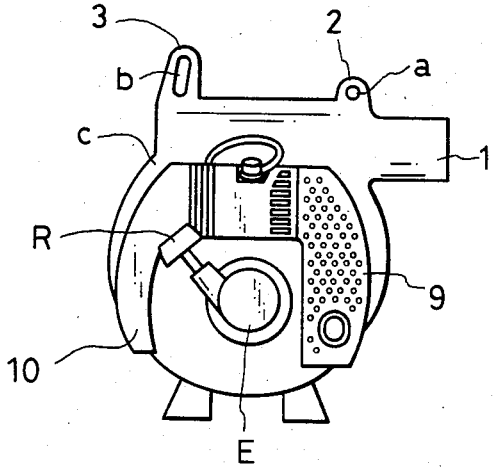
FIG. 5 is a front view of an engine blower with the handle removed.

In the present invention, when the engine E is started, the fan not shown is rotated to pressurize air introduced into the fan case C from the intake opening cover 8. The air is discharged as a compressed-air through the discharge opening 1 to scatter dust, sand, fine stones and others or dry wet material. As shown in FIG. 1, the bolt 5 is inserted into the lower ends of the adjusting holes b, b and the through hole h, and the upright member 3 is fastened by the bolt 6 to maintain the handle 4 in a horizontal state. Then, an operator (not shown) may carry the blower with him or may perform blowing work under the comfortable attitude. Furthermore, for example, the bolt 5 is inserted into the upper ends of the adjusting holes b, b and the through hole h, and the bolt 5 is fastened by the nut 6, when necessary, as shown in FIG. 6. Then, the discharge opening 1 is upwardly oriented and set, and the handle 4 itself may be maintained in a horizontal state similar to that shown in FIG. 1. With this, the operator may take a comfortable attitude when he carries the blower with him or performs air blowing work toward high-level objects such as trees, fences, doors and the like. So, the operator is free from a useless laborious burden.

Characteristic features

In handling a conventional portable engine blower, the handle is fixedly secured to the fan case, and an angle at which the handle is gripped is compelled to be changed every time the direction of the discahrge opening is changed, or time-taking work has been actually impossible to perform. On the other hand, in the present invention, the handle can be always maintained in a horizontal state through the adjusting holes irrespective of the change in direction of discharge. The operator can continuously perform work under the comfortable attitude. Moreover, the adjusting holes are provided in the fan case, and the horizontal position of the handle may be maintained through the aforesaid adjusting holes by adjustment of the registered position relative to the through hole on the handle side. Therefore, the device can be handled easily and is simple in construction.

What is claimed is:

1. A portable engine-blower supporting device comprising a fan casing provided with an engine and having a discharge opening on one side thereof, a pair of opposed projecting members on the discharge opening side at both ends of the upper surface of the fan casing, said pair of projecting members being disposed on either side of said discharge opening and defining horizontal circular holes therethrough at right angles to the axis of said discharge opening, a pair of opposed upright members provided on the side opposite the discharge opening, said upright members being disposed on either side of said discharge opening and defining horizontal oblong adjusting holes therethrough at right angles to the axis of said discharge opening, a flat inverted U-shaped handle having in each leg circular through holes respectively registering with the circular holes and the oblong adjusting holes of said projecting and upright members, respectively, a support shaft extending through said circular holes of said projecting members and said handle to permit said handle to pivot vertically with respect to said fan casing, a bolt extending through said oblong adjusting holes of said upright members and said handle and a nut for fastening onto said bolt to hold said handle in a horizontal state with respect to said fan casing.

* * * * *